US010603234B2

(12) United States Patent
Puvogel et al.

(10) Patent No.: US 10,603,234 B2
(45) Date of Patent: Mar. 31, 2020

(54) PATIENT SUPPORT APPARATUSES WITH DRIVE SYSTEMS

(71) Applicant: Stryker Corporation, Kalamazoo, MI (US)

(72) Inventors: Thomas Alan Puvogel, Kalamazoo, MI (US); Joshua A. Mansfield, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 227 days.

(21) Appl. No.: 15/471,361

(22) Filed: Mar. 28, 2017

(65) Prior Publication Data

US 2017/0281440 A1 Oct. 5, 2017

Related U.S. Application Data

(60) Provisional application No. 62/315,067, filed on Mar. 30, 2016.

(51) Int. Cl.
*A47B 71/00* (2006.01)
*A61G 7/08* (2006.01)
(Continued)

(52) U.S. Cl.
CPC ..... *A61G 7/08* (2013.01); *A61G 7/005* (2013.01); *A61G 7/0527* (2016.11);
(Continued)

(58) Field of Classification Search
CPC .. A61G 1/0275; A61G 1/0237; A61G 1/0281; A61G 1/0287; A61G 2203/42;
(Continued)

(56) References Cited

U.S. PATENT DOCUMENTS 5,210,476 A * 5/1993 Kazato ..... G05B 19/4062 318/560
5,789,884 A * 8/1998 Hancock ..... G05G 7/00 318/139
(Continued)

FOREIGN PATENT DOCUMENTS

CN 2915071 Y 6/2007
CN 200960241 Y 10/2007
(Continued)

*Primary Examiner* — Nicholas F Polito
*Assistant Examiner* — Morgan J McClure
(74) *Attorney, Agent, or Firm* — Warner Norcross + Judd LLP

(57) ABSTRACT

A patient support apparatus includes a frame, wheels, a patient support surface, a motor, a power assist control, a sensor, and a controller. The power assist control detects a force applied to it. The sensor detects an angular orientation of the patient support apparatus with respect to a generally horizontal plane. The controller drives the motor at different levels for a particular force applied to the power assist control depending upon the angular orientation sensed by the sensor. The controller may control the motors such that the patient support apparatus accelerates at substantially the same rate, regardless of the angle of the patient support apparatus. The controller may also limit the driving of the motor to less than a maximum value based upon the angular orientation of the patient support apparatus.

25 Claims, 7 Drawing Sheets

(51) Int. Cl.
*A61G 7/05* (2006.01)
*A61G 7/005* (2006.01)
*A61G 1/02* (2006.01)

(52) U.S. Cl.
CPC ..... *A61G 7/0528* (2016.11); *A61G 1/0237* (2013.01); *A61G 1/0275* (2013.01); *A61G 2203/32* (2013.01); *A61G 2203/42* (2013.01); *A61G 2203/726* (2013.01)

(58) Field of Classification Search
CPC ..... A61G 2203/726; A61G 2203/32; A61G 7/08; A61G 7/0527; A61G 7/0528; A61G 7/005
See application file for complete search history.

(56) References Cited

U.S. PATENT DOCUMENTS 5,927,423 A 7/1999 Wada et al.
6,321,878 B1 11/2001 Mobley et al.
6,459,962 B2 10/2002 Ulrich et al.
6,752,224 B2 * 6/2004 Hopper ..... A61G 7/08 180/19.1
6,834,402 B2 12/2004 Hanson et al.
6,871,714 B2 * 3/2005 Johnson ..... A61G 7/08 180/19.2
7,389,552 B1 6/2008 Reed et al.
7,419,019 B1 * 9/2008 White ..... A61G 7/08 180/19.1
7,481,286 B2 1/2009 Ruschke et al.
7,953,537 B2 * 5/2011 Bhai ..... A61G 7/08 5/81.1 R
8,196,944 B1 6/2012 Vondrak
8,266,742 B2 9/2012 Andrienko
8,442,738 B2 5/2013 Patmore
8,720,616 B2 5/2014 Kofoed et al.
8,984,685 B2 3/2015 Robertson et al.
9,220,651 B2 12/2015 Hyde et al.
10,045,893 B2 8/2018 Childs et al.
2002/0013965 A1 * 2/2002 Wilson ..... A61B 6/0457 5/600
2003/0009825 A1 1/2003 Gallant et al.
2003/0183427 A1 10/2003 Tojo et al.
2005/0236208 A1 10/2005 Runkles et al.
2006/0059623 A1 * 3/2006 Karmer, Jr. ..... A61G 7/012 5/616
2006/0102392 A1 5/2006 Johnson et al.
2007/0157385 A1 * 7/2007 Lemire ..... A61G 7/005 5/600
2007/0174965 A1 * 8/2007 Lemire ..... A61G 7/005 5/600
2008/0084175 A1 4/2008 Hollis
2008/0141459 A1 * 6/2008 Hamberg ..... A61G 7/018 5/600
2008/0172789 A1 * 7/2008 Elliot ..... G06F 19/00 5/616
2008/0189865 A1 * 8/2008 Bhai ..... A61G 7/05769 5/706
2009/0153370 A1 * 6/2009 Cooper ..... G05G 9/047 341/21
2009/0165208 A1 * 7/2009 Reed ..... A61G 1/052 5/611
2011/0087416 A1 * 4/2011 Patmore ..... A61G 1/048 701/93
2011/0225733 A1 * 9/2011 Figel ..... A61G 1/0225 5/611
2011/0307133 A1 12/2011 Brandon
2012/0047655 A1 * 3/2012 O'Keefe ..... A61G 7/012 5/610
2012/0259248 A1 * 10/2012 Receveur ..... G16H 50/30 600/595
2012/0283746 A1 11/2012 Hu et al.
2013/0008732 A1 1/2013 Richter
2014/0090171 A1 * 4/2014 Hyde ..... A61G 1/0275 5/600
2014/0094997 A1 * 4/2014 Hyde ..... G05D 1/0246 701/2
2014/0150806 A1 6/2014 Hu et al.
2015/0129333 A1 * 5/2015 Morris ..... A61G 1/0275 180/65.8
2015/0135439 A1 * 5/2015 G ..... A61G 7/012 5/611
2015/0245969 A1 * 9/2015 Hight ..... A61G 13/04 5/600
2015/0291176 A1 * 10/2015 Jeong ..... B60W 40/076 701/468
2015/0298765 A1 * 10/2015 Golden, Jr. ..... A61G 5/10 180/206.3
2016/0059928 A1 * 3/2016 Yeh ..... A61G 5/022 701/22
2016/0089283 A1 * 3/2016 DeLuca ..... A61G 1/0243 180/413
2016/0128880 A1 * 5/2016 Blickensderfer .... A61G 1/0212 296/20
2016/0136018 A1 * 5/2016 DeLuca ..... A61G 7/012 5/611
2016/0367415 A1 * 12/2016 Hayes ..... A61G 1/0281
2017/0143565 A1 * 5/2017 Childs ..... A61G 7/018
2017/0143566 A1 * 5/2017 Elku ..... A61G 7/018
2018/0135987 A1 * 5/2018 Evans ..... A61G 5/04
2018/0178706 A1 * 6/2018 Takahata ..... A61G 5/042
2018/0185211 A1 * 7/2018 Uemura ..... A61G 5/024
2018/0252535 A1 * 9/2018 Bhimavarapu ..... A61G 1/04
2019/0029899 A1 * 1/2019 Mulhern ..... A61G 5/122

FOREIGN PATENT DOCUMENTS

DE 19949351 A1 7/2001
EP 0630637 A1 12/1994
EP 2208487 A3 7/2010
JP 2000016298 A 1/2000
WO 2005041837 A2 5/2005
WO 2009113009 A1 12/2009
WO 2012055407 A1 5/2012

* cited by examiner

PATIENT SUPPORT APPARATUSES WITH DRIVE SYSTEMS

CROSS-REFERENCE TO RELATED APPLICATIONS

This application claims priority to U.S. provisional patent application Ser. No. 62/315,067 filed Mar. 30, 2016, by inventors Thomas Puvogel et al. and entitled PATIENT SUPPORT APPARATUSES WITH DRIVE SYSTEMS, the complete disclosure of which is incorporated herein by reference.

BACKGROUND OF THE INVENTION

The present disclosure relates to patient support apparatuses, such as beds, cots, stretchers, operating tables, recliners, or the like.

Modern health care facilities utilize a wide variety of patient support apparatuses. Examples of such patient support apparatuses include beds, stretchers, cots, surgery tables, wheelchairs, recliners, and other types of apparatuses that are designed to help support a patient. Most of these apparatuses include one or more wheels that enable them to be pushed throughout different areas of a health care facility, such as a hospital, a nursing home, an assisted living center, or other environments where such patient support apparatuses are used. In some prior art versions, the patient support apparatuses have included a propulsion system having one or more motors that drive one or more of the wheels and thereby propel the patient support apparatus. Such propulsion systems ease the force that caregivers and other personnel must exert on the patient support apparatus when the apparatus is moved to different locations.

SUMMARY OF THE INVENTION

According to various embodiments, the present disclosure provides a patient support apparatus having one or more improved features that allow a caregiver, or other user, to more efficiently use the patient support apparatus. For example, in at least one embodiment, the patient support apparatus includes one or more sensors that detect an inclination or declination angle of the patient support apparatus and adjust the power applied to the motor in order to accommodate the sensed incline or decline. In another embodiment, acceleration of the patient support apparatus by the propulsion system is detected and used as feedback for controlling the motor such that the response of the propulsion system to an applied force is substantially the same, regardless of the load on the support apparatus and regardless of any incline or decline in the floor over which the patient support apparatus is traveling. In still other embodiments, one or more sensors are used in combination with a motor current sensor to detect potential faults in the propulsion system and notify technicians, when appropriate. In still other embodiments, a drive system on the patient support apparatus detects collisions and automatically responds to them, and/or the drive system detects a tilt angle and limits unsafe movement in light of the tilt angle.

According to one embodiment, a patient support apparatus is provided that includes a frame, wheels, a patient support surface, a motor, a power assist control, a sensor, and a controller. The power assist control detects a force applied to the power assist control. The sensor detects an angular orientation of the patient support apparatus with respect to a substantially horizontal plane. The controller is in communication with the power assist control, the motor, and the sensor, and is adapted to drive the motor at different levels based upon the angular orientation sensed by the sensor.

According to another embodiment, a patient support apparatus is provided that includes a frame, wheels, a patient support surface, a motor, a power assist control, a sensor, and a controller. The power assist control detects a force applied to the power assist control. The sensor detects an angular orientation of the patient support apparatus with respect to a substantially horizontal plane. The controller is in communication with the power assist control, the motor, and the sensor. The controller is also adapted to drive the motor such that the patient support apparatus accelerates at substantially the same rate when a particular force is applied to the power assist control, regardless of the angular orientation of the patient support apparatus.

According to another embodiment, a patient support apparatus is provided that includes a frame, wheels, a patient support surface, a motor, a power assist control, a sensor, and a controller. The power assist control detects a force applied to the power assist control. The sensor is adapted to detect an acceleration of the patient support apparatus when the motor drives the wheel or wheels. The controller is in communication with the power assist control and the motor. The controller also drives the motor in a manner based on the applied force and an output from the sensor.

According to still another embodiment, a patient support apparatus is provided that includes a frame, wheels, a patient support surface, a motor, a power assist control, an acceleration sensor, and a controller. The power assist control detects a force applied to the power assist control. The acceleration sensor detects an acceleration of the patient support apparatus when the motor drives the wheel or wheels. The current sensor detects the amount of current drawn by the motor. The controller is in communication with the power assist control, the motor, the acceleration sensor and the current sensor. The controller also compares the amount of current drawn by the motor with the acceleration detected by the acceleration sensor to determine if an error condition exists.

In still another embodiment, a patient support apparatus is provided that includes a frame, wheels, a patient support surface, a motor, a power assist control, an acceleration sensor, and a controller. The power assist control detects a force applied to the power assist control. The acceleration sensor detects the acceleration of the patient support apparatus when the motor drives the wheel or wheels. The controller is in communication with the power assist control, the motor, and the acceleration sensor. The controller also detects a collision of the patient support apparatus and automatically slows down the patient support apparatus in response to the detected collision.

According to other embodiments, the controller drives the motor at a first level when the patient support apparatus is oriented at a first angular orientation and the particular force is applied, and the controller drives the motor at a higher level when the patient support apparatus is oriented at a more inclined angular orientation and the same particular force is applied.

In some embodiments, the patient support apparatus also includes a scale coupled to the patient support surface and adapted to detect a weight on the patient support surface. The controller drives the motor at different levels for the particular force applied to the power assist control depending upon the weight detected by the scale.

The controller drives the motor at different levels, in at least one embodiment, by sending pulse width modulated signals of different duty cycles to the motor.

In some embodiments, the sensor used to detect the angular orientation of the patient support apparatus with respect to a horizontal plane is also used to detect an acceleration of the patient support apparatus due to the motor being driven. This acceleration may be used by the controller to determine at what level to drive the motor. In some embodiments, the controller uses feedback from the acceleration sensor to drive the motor such that it accelerates at substantially the same rate when the particular force is applied, regardless of the angular orientation sensed by the sensor and/or the load of the patient support apparatus.

In at least one embodiment, the patient support apparatus is a bed having a litter, a plurality of handles mounted to the litter, and a plurality of lifts adapted to raise and lower the litter. The litter supports the patient support surface and the power assist control is integrated into the plurality of handles.

In still other embodiments, the controller drives the motor at no more than a safety level if the sensor detects a potentially unsafe orientation of the patient support apparatus and/or equipment supported on the patient support apparatus (e.g. an IV pole, a heart monitor, an oxygen tank, etc.). The safety level may be variable depending upon the angular orientation of the patient support apparatus, the weight of the patient support apparatus, and/or other factors. The safety level represents a reduced level from what the controller would otherwise drive the motor at were the patient support apparatus level. In some embodiments, the safety level is zero and the controller prevents and/or stops the motor from being driven.

In some embodiments, the controller is further adapted to prevent a brake from being applied while the patient support apparatus is in motion.

The controller, in some embodiments, brakes the motor such that the patient support apparatus decelerates at substantially the same rate when a particular braking force is applied, regardless of the angular orientation of the patient support apparatus.

The controller drives the motor at different levels, in some embodiments, by sending pulse width modulated (PWM) signals of different duty cycles to the motor In some embodiments, the controller uses acceleration detected by the acceleration sensor for closed-loop feedback control of the motor.

A memory is included in some embodiments that stores data containing an acceptable range of motor current draw for a particular acceleration. When so included, the controller issues an alert to the user if the motor draws current outside of the acceptable range for the particular acceleration. If the current draw exceeds the acceptable range by more than a threshold, the controller stops driving the motor until the patient support apparatus is serviced by a technician.

The controller automatically slows down the patient support apparatus by taking one or more of the following three actions: (1) terminating power to the motor; (2) driving the motor in an opposite direction; and/or (3) applying a mechanical brake to one or more of the wheels on the patient support apparatus.

In those embodiments where the controller prevents the brake from being applied while the patient support apparatus is in motion, the controller only prevents the brake from being applied if there is no collision detected. If a collision is detected, the controller automatically terminates power to the motor that is propelling the patient support apparatus.

In still another embodiment, a patient support apparatus is provided that includes a frame, wheels, a patient support surface, a motor, first and second sensors, and a controller. The motor is adapted to drive at least one of the wheels. The first and second sensors are adapted to detect first and second parameters, respectively. The controller is in communication with the motor and the first and second sensors. The controller is also adapted to drive the motor based upon outputs from both the first and second sensors.

In some embodiments, the first sensor is a force sensor and the first parameter is an amount of force applied by a user to the patient support apparatus. Further, in some embodiments, the second sensor is a force sensor and the second parameter is an amount of weight supported on the patient support surface.

A third sensor is included in some embodiments that detects a third parameter, and the controller drives the motor based upon an output from the third sensor. In at least one embodiment, the second sensor is a force sensor, the second parameter is an amount of weight supported on the patient support surface, the third sensor is an orientation sensor, and the third parameter is an angular orientation of the patient support apparatus relative to a substantially horizontal plane.

In still another embodiment, a patient support apparatus is provided that includes a frame, wheels, a patient support surface, a motor, a power assist control, a sensor, a brake, and a controller. The motor is adapted to drive at least one of the wheels. The power assist control detects a force applied to the patient support apparatus. The sensor detects an acceleration of the patient support apparatus when the motor drives at least one of the wheels. The controller uses outputs from the sensor to determine when the patient support apparatus is in motion and to prevent the brake from being activated by a user while the patient support apparatus is in motion.

According to still another embodiment, a patient support apparatus is provided that includes a frame, wheels, a patient support surface, a motor, a power assist control, a sensor, and a controller. The motor drives at least one of the wheels. The power assist control detects a force applied to the patient support apparatus. The sensor detects an angular orientation of the patient support apparatus with respect to a substantially horizontal plane. The controller determines a maximum value used in driving the motor based upon the angular orientation sensed by the sensor. The controller also drives the motor in response to the force applied to the power assist control in a manner such that the maximum value is not exceeded.

The controller also uses a weight from a scale in determining the maximum value, in some embodiments. The maximum value is a maximum acceleration in some embodiments, and a maximum speed in other embodiments. The maximum value may be automatically re-determined based upon subsequently detected angular orientations of the patient support apparatus as detected by the sensor.

Before the various embodiments disclosed herein are explained in detail, it is to be understood that the claims are not to be limited to the details of operation or to the details of construction and the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
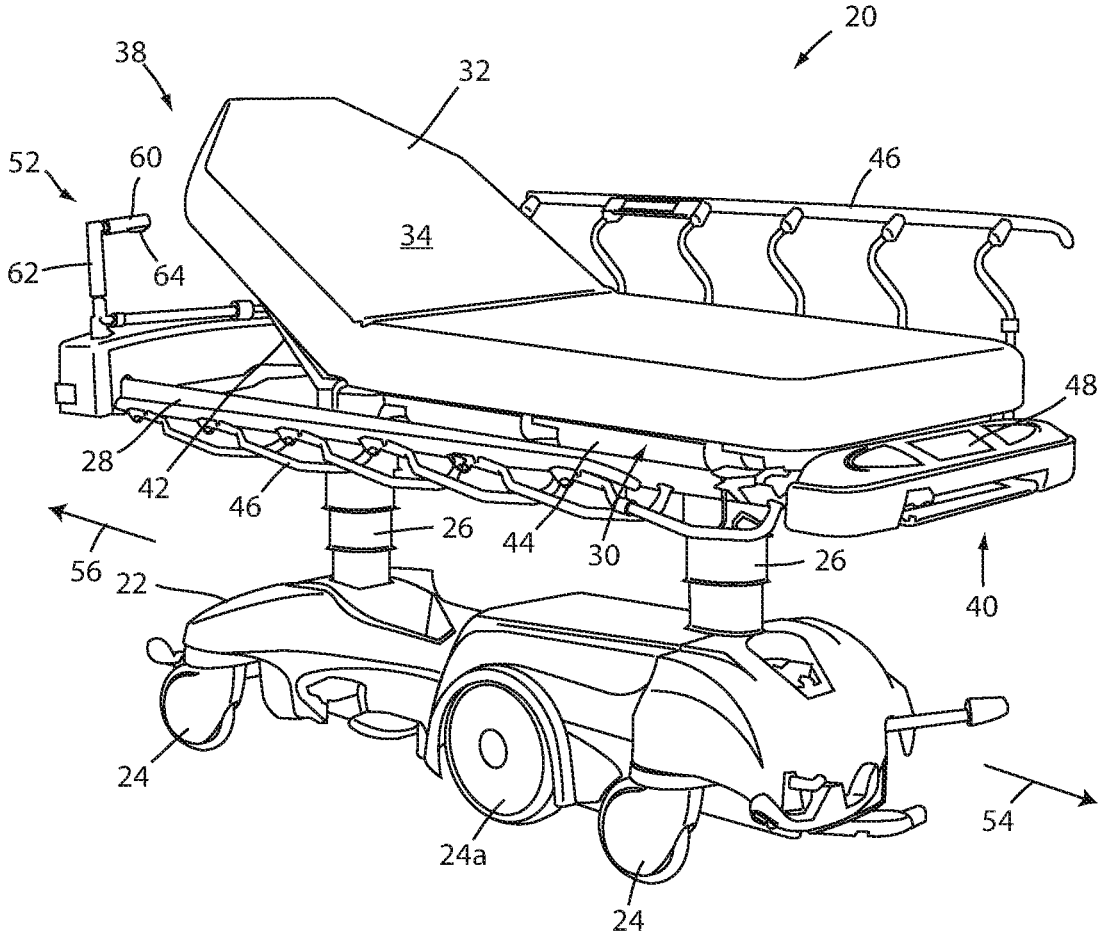
FIG. 1 is a perspective view of a patient support apparatus according to a first embodiment.

A patient support apparatus 20 according to one embodiment is shown in FIG. 1. Patient support apparatus 20, as shown in FIG. 1, is implemented as a stretcher. It will be understood, however, that patient support apparatus 20 can be alternatively implemented as a bed, a cot, a recliner, or other apparatus that is capable of supporting a person.

Patient support apparatus 20 of FIG. 1 includes a base 22 having a plurality of wheels 24, a pair of lifts 26 supported on the base, a frame or litter 28 supported by the lifts 26, and a deck 30 that is supported on top of litter 28. Lifts 26 are adapted to raise and lower frame 28 and deck 30 with respect to base 22. Lifts 26 may include a combination of hydraulic actuators and electric actuators, or they may be entirely electric. Deck 30 supports a mattress 32, or other cushioning device, on which a patient may sit or lie. A top side of mattress 32 provides a support surface 34 for the patient. The patient typically lies on mattress 32 such that his or her head is positioned adjacent a head end 38 of patient support apparatus 20 and his or her feet are positioned adjacent a foot end 40 of patient support apparatus 20.

Support deck 30 is made of a plurality of sections, some of which are pivotable about generally horizontal pivot axes. In the embodiment shown in FIG. 1, support deck 30 includes an upper or head section 42 and a lower or foot section 44. Head section 42, which is also sometimes referred to as a Fowler section, is pivotable between a generally horizontal orientation (not shown in FIG. 1) and a plurality of raised positions (one of which is shown in FIG. 1).

A plurality of side rails 46 (FIG. 1) may also be coupled to frame 28. If patient support apparatus 20 is a bed, there may be four such side rails, one positioned at a left head end of frame 28, a second positioned at a left foot end of frame 28, a third positioned at a right head end of frame 28, and a fourth positioned at a right foot end of frame 28. If patient support apparatus 20 is a stretcher, such as shown in FIG. 1, or a cot, there may be fewer side rails, such as one siderail 46 on each side of patient support apparatus 20. In other embodiments, there may be no side rails on patient support apparatus 20. Regardless of the number of side rails, such side rails are movable between a raised position in which they block ingress and egress into and out of patient support apparatus 20, and a lowered position in which they are not an obstacle to such ingress and egress.

The construction of any of base 22, lifts 26, frame 28, support deck 30, and/or side rails 46 may take on any known or conventional design, such as, for example, those disclosed in commonly assigned, U.S. Pat. No. 7,395,564 issued to McDaniel et al. and entitled ARTICULATED SUPPORT SURFACE FOR A STRETCHER OR GURNEY, or commonly assigned U.S. Pat. No. 6,230,343 issued to Buiskool et al. and entitled UNITARY PEDAL CONTROL FOR HEIGHT OF A PATIENT SUPPORT, the complete disclosures of both of which are incorporated herein by reference. The construction of any of base 22, lifts 26, frame 28, support deck 30, and/or the side rails 46 may also take on forms different from what is disclosed in the aforementioned patents.

Patient support apparatus 20 also includes a control panel 48 positioned at foot end 40 of support deck 30 (FIG. 1). Control panel 48 includes a plurality of buttons and/or other controls that allow a user to control several of the powered and/or electronic functions of patient support apparatus 20. For example, control panel 48 allows a user to control lifts 26 in order to change the height of support deck 30. Control panel 48 may also include controls for controlling an exit detection system, or for controlling still other functions.

Patient support apparatus 20 further includes a drive system 50 for selectively driving at least one powered wheel 24*a* (FIG. 3) via one or more motors 58. Drive system 50 is integrated into patient support apparatus 20 and reduces the amount of force required by a caregiver to push patient support apparatus 20 from one location to another. A pair of power assist controls 52 (only one visible in FIG. 1; both visible in FIG. 2) are positioned at head end 38 of patient support apparatus 20 and are used to control the driven wheel 24*a*. As will be discussed in greater detail below, when a user pushes in a forward direction 54 or a reverse direction 56 (FIG. 1) on one or both of power assist controls 52, the drive system 50 drives wheels 24*a* such that the patient support apparatus 20 moves in the forward or reverse direction 54 or 56.

Figure 2:
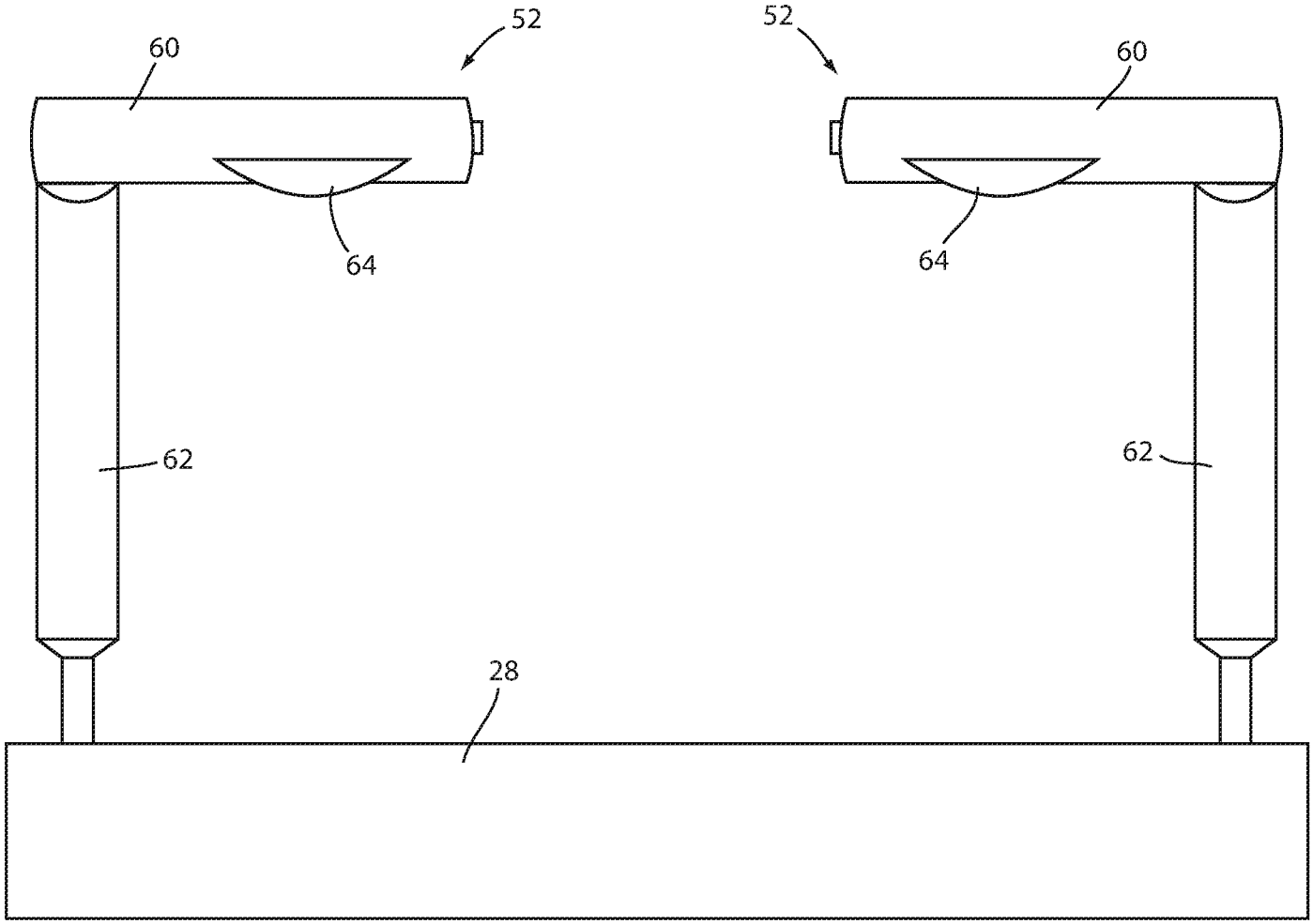
FIG. 2 is a rear elevation view of a pair of power assist controls of the patient support apparatus of FIG. 1.

FIG. 2 shows an enlarged view of one manner in which the power assist controls 52 of drive system 50 can be physically implemented on patient support apparatus 20. As shown in FIG. 2, each power assist control 52 includes a handle 60 coupled to a post 62 which is, in turn, coupled to frame 28. Posts 62 generally extend upward from litter 28 in a vertical direction. Handles 60 are coupled to posts 62 at substantially right angles.

An enable switch 64 is positioned on handle 60 and is activated when pressed by a user. Enable switch 64 is used to enable and disable the control of drive system 50. That is, before a user can use power assist control 52 to control the drive system 50, the user must activate at least one of the enable switches 64. In the embodiment shown, enable switch 64 is a button that must be pushed in order to be activated and to thereby enable drive system 50. Enable switch 64 can be physically implemented in other forms. Regardless of its physical form, enable switch 64 must remain pressed, or otherwise activated, in order for drive system 50 to continue to drive wheel 24*a*. Enable switch 64 therefore acts like a conventional dead-man's switch and provides a fail-safe mechanism for preventing uncontrolled driving of patient support apparatus 20.

Each handle 60 includes one or more force sensors 72 (FIG. 3) that detect forward and reverse forces applied to the handle 60 by a user. The specific type of force sensor 72 integrated into handles 60, as well as the overall construction of handle 60 and its corresponding force sensor 72 may vary widely. In at least one embodiment, handle 60 is constructed in one or more of the manners disclosed in commonly assigned U.S. patent application Ser. No. 62/184,570 filed Jun. 25, 2015 by inventors Jerald Trepanier et al. and entitled PATIENT SUPPORT APPARATUSES WITH DRIVE CONTROLS, the complete disclosure of which is hereby incorporated herein by reference. When constructed in any of these manners, handle 60 includes one or more load cells that act as force sensors 72 and detect the amount of forward and rearward force applied by a user to handle 60. The sensed force is communicated to a controller 68 (FIG. 3), as will be discussed in greater detail below. In several embodiments, the application of a rearward force to handle 60 (coupled with the activation of one of the enable switches 64) causes the drive system to drive wheel 24*a* in reverse, thereby providing propulsion assistance in the rearward direction as well as the forward direction.

As an alternative to using one or more load cells as force sensors 72 for detecting the force applied by a user to handle 60, power assist controls 52 can be physically constructed to use one or more potentiometers that sense rotation of handles 60 about a substantially horizontal and laterally extending axis. In such an embodiment, the degree of rotation about this axis is proportional to the amount of applied force. One example of the physical construction of such a potentiometer-based power assist control is disclosed in commonly assigned U.S. Pat. No. 6,772,850 issued to Waters et al., and entitled POWER ASSISTED WHEELED CARRIAGE, which issued on Aug. 10, 2004, the complete disclosure of which is hereby incorporated herein by reference. Other manners of using a potentiometer for detecting force may also be used. Still further, force sensors 72 that do not involve either load cells or potentiometers may also be used in some embodiments.

Drive System 50

Figure 3:
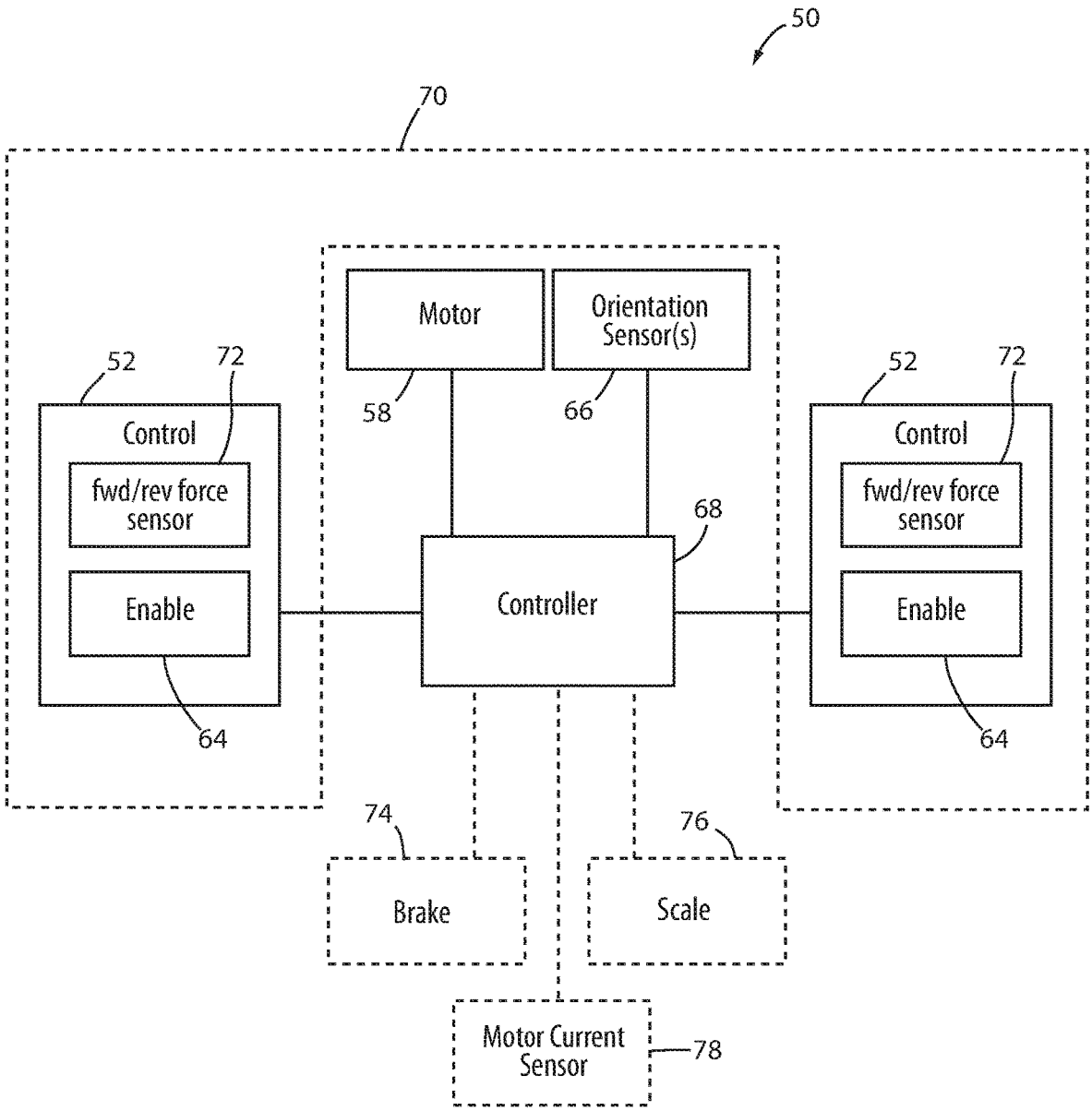
FIG. 3 is a block diagram of a first embodiment of a drive system usable with the patient support apparatus of FIG. 1.

Turning now to a more detail discussion of drive system 50, FIG. 3 illustrates in greater detail one embodiment of drive system 50 that may be incorporated into patient support apparatus 20. Drive system 50 includes power assist controls 52, motor 58, one or more sensors 66, and a controller 68. Power assist controls 52 collectively form a propulsion control user interface 70. Motor 58 drives powered wheel 24*a*. Sensor 66, in at least one embodiment, is a multi-axis accelerometer adapted to detect whether or not patient support apparatus 20 is on a level floor or not, and if not, the angular deviation from horizontal, as will be explained in greater detail below.

Controller 68 is a microcontroller, in at least one embodiment. It will be understood, however, the controller 68 may take on other forms. In general, controller 68 includes any one or more microprocessors, microcontrollers, field programmable gate arrays, systems on a chip, volatile or nonvolatile memory, discrete circuitry, and/or other hardware, software, or firmware that is capable of carrying out the functions described herein, as would be known to one of ordinary skill in the art. Such components can be physically configured in any suitable manner, such as by mounting them to one or more circuit boards, or arranging them in other manners, whether combined into a single unit or distributed across multiple units. The instructions followed by controller 68 in carrying out the functions described herein, as well as the data necessary for carrying out these functions, are stored in a memory (not labeled) accessible to controller 68.

As is also shown in FIG. 3, the outputs of the forward/reverse force sensors 72 and the enables switches 64 are all fed to controller 68, which in turn sends commands to motor 58. In at least one embodiment, the commands sent to motor 58 are pulse width modulated (PWM) signals wherein the duty cycle of the PWM signal dictates how hard the motor will be driven. In other words, the higher the duty cycle, the higher the torque generated by the motor. Further, the higher the torque generated by the motor, the greater the force that is applied to the patient support apparatus 20 by motor 58.

In some embodiments, controller 68 may also be in communication with a brake 74, a scale 76, and/or a motor current sensor 78. These components are illustrated in FIG. 3 in dashed lines to underscore the optionality of these components and the fact that some embodiments of the drive system 50 shown in FIG. 3 do not include any or all of these components. The function of these components, as well as controller 68's interaction with them will be discussed in greater detail below. In addition to including or not including any one or more of the brake 74, scale 76, and motor current sensor 78, it will be understood that user interface 70 can be modified in some embodiments to include a smaller or greater number of power assist controls 52 than the two illustrated in FIG. 3.

In operation, when enable switch 64 is activated (such as by pressing), it sends a signal to controller 68. Controller 68 responds to the signal by allowing any forward or reverse forces applied to handle 60, and detected by forward/reverse force sensor 72, to be used to control motor 58. If controller 68 does not receive an activation signal from an enable switch 64, it will not allow any forward or reverse signals it receives from forward/reverse force sensors 72 to be used to control motor 58. As a result, the pushing or pulling on handles 60 in a forward or reverse direction by a user who has not also activated an enable switch 64 will not result in any power being delivered to motor 58, and patient support apparatus 20 will not move in a powered manner in response to such pushing or pulling by the user. Still further, when a user initially activates an enable switch 64 and begins driving patient support apparatus 20 using one or power assist controls 52, but then deactivates the enable switch 64 while the patient support apparatus 20 is still moving, controller 68 will terminate power to motor 58 (and, in some cases, bring patient support apparatus 20 to a complete stop before allowing the patient support apparatus to be manually pushed or pulled).

As shown in FIG. 3, drive system 50 includes two power assist controls 52 that each have their own associated enable switch 64. In one embodiment of drive system 50, it is only necessary for a user to press (or otherwise activate) a single one of the two enable switches 64 in order to enable the controller 68 to drive motor 58. In other words, it is not necessary for a user to activate both of the enable switches 64 in order to have controller 68 drive motor 58. Further, in some embodiments, activation of the enable switch 64 on the right handle 60 enables motor 58 to be driven in response to forces applied to the left force sensor 72, and vice versa. In still other embodiments, activation of the enable switch 64 only causes controller 68 to respond to the force sensor 72 of the handle 60 that has the activated enable switch 64 (e.g. one cannot use the left handle to drive the motor 58 when only the enable switch 64 of the left handle has been activated). Still further, in some embodiments, the two power assist controls 52 are mechanically linked to a single common force sensor 72 that sends it output to controller 68.

Figure 4:
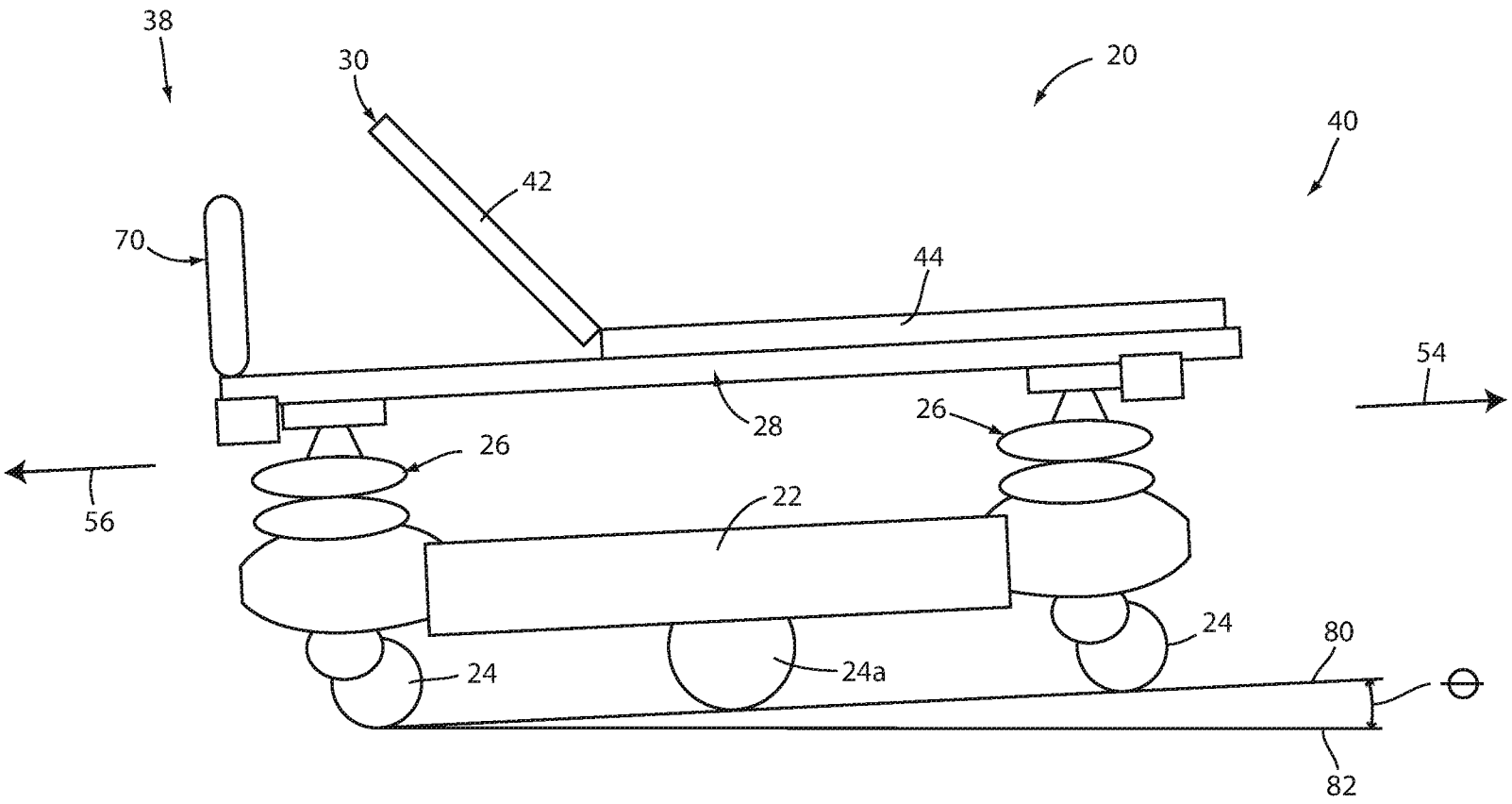
FIG. 4 is a side elevation diagram of the patient support apparatus of FIG. 1 shown on an incline.

In some embodiments, controller 68 is programmed to control motor 58 in different manners depending upon the angle of incline or decline of the patient support apparatus 20. These embodiments are better understood with reference to FIG. 4. As shown in FIG. 4, patient support apparatus 20 is positioned on a floor 80. Further, in the illustrative example of FIG. 4, floor 80 is inclined upwardly from a substantially horizontal plane 82. A tilt angle theta (θ) is therefore defined between the plane of floor 80 and generally horizontal plane 82. Sensor 66 senses the magnitude of tilt angle theta and reports it to controller 68. Controller 68 uses this angle to adjust the signals it sends to motor 58 in response to a user applying a force to either of power assist controls 52 (and an enable switch 64 being activated).

In general, controller 68 is programmed such that, in response to a given forward force applied to one of sensors 72, it sends PWM signals having higher duty cycles when patient support apparatus 20 is on an incline than it would if patient support apparatus 20 were on a level floor, or a downwardly angled floor (i.e. a decline). The specific duty cycle chosen by controller 68 varies in response to the magnitude of angle theta such that steeper and steeper inclines result in controller 68 driving motor 58 at higher and higher levels. Controller 68 is also programmed such that, when patient support apparatus 20 is positioned on a downwardly sloped floor (i.e. angle theta in FIG. 4 is negative) and a given forward force is applied to one of sensors 72, it sends PWM signals having smaller duty cycles than it would were patient support apparatus 20 positioned on a level floor. Controller 68 therefore automatically adjusts its response to forces applied to handles 60 (and sensed by sensors 72) based on the current inclination or declination of patient support apparatus 20.

In at least one embodiment, this automatic adjustment is carried out such that patient support apparatus 20 accelerates on an incline or decline, in response to a given force detected by one of sensors 72, in the same manner as patient support apparatus 20 does when accelerated on a level surface. The caregiver who is pushing or pulling on patient support apparatus 20 therefore does not have to push harder to drive the patient support apparatus up an incline, nor does he or she have to push more lightly to drive the patient support apparatus down a decline.

Figure 5:
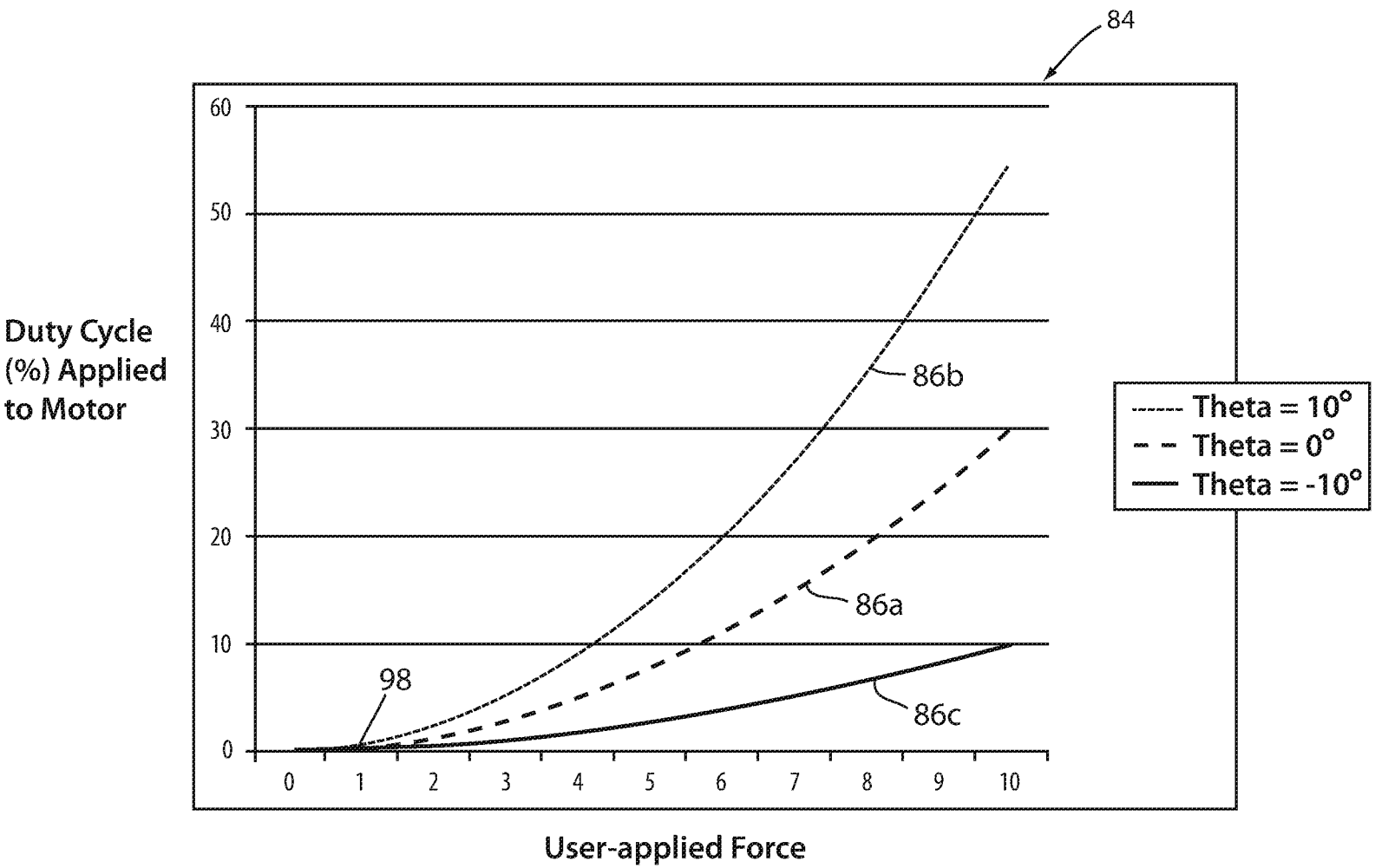
FIG. 5 is a chart illustrating several different profiles of the relationship between the force applied to the power assist control and the level at which the drive system of FIG. 3 drives the motor for different inclination angles.

One example of the type of response controller 68 may be programmed to execute in response to applied forces to power assist controls 52 and a sloped floor are depicted in FIG. 5. More specifically, FIG. 5 illustrates a graph 84 depicting several different illustrative profiles 86*a-c* of the relationship between the applied force and the level at which motor 58 is driven. It will be understood by those skilled in the art that the shapes of the profiles 86*a-c* illustrated in FIG. 5 are but one of many different shapes that may be implemented by controller 68 and are not the only types of shapes controller 68 may implement. Graph 84 includes an x-axis indicating the amount of force applied by a user and detected by force sensor 72. The units of the x-axis are unlabeled, but may comprise any conventional units for measuring force, such as pounds, newtons, fractions of these, or still other units. The y-axis indicates the duty cycle which controller 68 selects for the PWM signals it sends to drive motor 58. The units of the duty cycle are percentages and range from zero to 100 percent.

A first profile 86*a* of the three profiles 86*a-c* depicted in FIG. 5 shows the relationship between the user-applied force and the level at which controller 68 drives motor 58 when the tilt angle theta is equal to zero. As noted previously in the discussion of FIG. 4, tilt angle theta is equal to zero when the floor 80 on which patient support apparatus 20 is level. A second profile 86*b* shows the relationship between the user-applied force and the level at which controller 68 drives motor 58 when theta is equal to ten degrees (i.e. patient support apparatus 20 is confronting a ten degree incline). A third profile 86*c* shows the relationship between the user applied force and the level at which controller 68 drives motor 58 when theta is equal to minus ten degrees (i.e. patient support apparatus 20 is confronting a ten degree decline).

As previously indicated, the shapes of profiles 86*a-c* are merely illustrative of the many different types of shapes that controller 68 could be programmed to implement. In alternative embodiments, instead of the generally exponential shape of profiles 86*a-c* shown in FIG. 5 that approach a vertical asymptote, controller 68 implements profiles that are not exponentially shaped and/or that approach a horizontal asymptote. In still other embodiments, controller 68 may be programmed to implement profiles 86 that are discontinuous. Still other variations are possible.

Regardless of the precise shape of the profiles 86, it will be understood by those skilled in the art that the depiction of only three profiles in FIG. 5 represent an incomplete depiction of the profiles followed by controller 68. That is, controller 68 is programmed to follow still other profiles (not shown in FIG. 5) when theta has values other than −10, 0, and 10 degrees. In at least one embodiment, controller 68 uses a mathematical formula in which the applied force and the theta value detected by sensor 66 are variables in order to calculate the level at which motor 58 is driven. Depending upon which specific formula is used, the resulting profile 86 may take on a unique shape for each different value of theta.

Controller 68 determines the duty cycle to apply to motor 58 repetitively based on the detected theta value and applied force. As a result, unless the floor is angled at a constant value and the user pushes on power assist control 52 with a constant force, the duty cycle applied to motor 58 by controller 68 will change.

Although the discussion of profiles 86 and controller 68's reaction to the different theta angles has so far focused primarily upon a force being applied to power assist control 52 in forward direction 54, controller 68 is programmed to also adjust the power applied to motor 58 based on the value of angle theta when power assist control 52 is pulled in the reverse direction 56. Thus, for example, in the example illustrated in FIG. 4, if a user pulls on one of power assist controls 52 in reverse direction 56, controller 68 will send a PWM signal to motor 58 having a duty cycle that is less than it otherwise would if patient support apparatus 20 were on a level floor. This is because the floor 80 is angled downwardly in the reverse direction 56 so gravity will assist in the backward movement of patient support apparatus 20. As a result, it is not necessary to drive motor 58 as hard as when it otherwise would be were patient support apparatus 20 to be on a level surface.

As was noted previously, in an alternative embodiment of drive system 50, patient support apparatus 20 includes a scale 76 that detects the amount of weight supported on patient support surface 34 and reports this weight to controller 68. Such scales are known in the art. One such example of a scale that can be used with drive system 50 is disclosed in commonly assigned U.S. patent application Ser. No. 14/212,367 filed Mar. 14, 2014 by inventors Michael Hayes et al. and entitled PATIENT SUPPORT APPARATUS WITH PATIENT INFORMATION SENSORS, the complete disclosure of which is hereby incorporated herein by reference. Another scale example is found in commonly assigned U.S. Pat. No. 5,276,432 issued to Travis on Jan. 4, 1994, and entitled PATIENT EXIT DETECTION MECHANISM FOR HOSPITAL BED, the complete disclosure of which is hereby incorporated herein by reference. Still other types of scales may be used.

When drive system 50 is modified to receive a weight reading from scale 76, controller 68 adjusts the duty cycle of the PWM signals sent to motor 58 in order to accommodate the reported weight. In general, the greater the weight, the higher the duty cycle (for a level or inclined floor); and the lower the weight, the lower the duty cycle (for a level or inclined floor). On a declining floor, controller 68 reduces the duty cycle more and more in response to heavier and heavier weights. In determining what specific duty cycle to use for a given scale reading, theta angle, and applied force, controller 68 may be programmed with a formula and/or a plurality of profiles that relate these three inputs to a desired PWM value. When programmed with a formula, controller 68 utilizes the three measured variables (scale reading, theta angle, and applied force) to calculate the desired PWM duty cycle. The formula may be a continuous or a discontinuous mathematical function, or it may be defined by a non-mathematically defined set of rules. The specific formula may also be based upon empirical data gathered from a particular patient support apparatus 20 that has been tested on floors with varying tilt levels and varying weights.

As was noted previously, the profiles used by controller 68—whether based on only two variables (theta and applied force) or three variables (theta, applied force, and scale reading)—are designed in at least one embodiment such that patient support apparatus 20 is accelerated and decelerated at substantially the same rate (in response to a given applied force), regardless of whether the patient support apparatus is traveling on a level or non-level floor, and regardless of the amount of weight supported on the patient support apparatus 20. In other embodiments, the profiles 86 followed by controller 68 may be based on other goals and/or criteria.

When controller 68 is programmed to follow one of the profiles 86 discussed above, and even when such profiles 86 are designed to provide uniform acceleration of patient support apparatus 20 for different theta angles and different loads, the acceleration and deceleration of patient support apparatus 20 may vary somewhat depending upon the theta angles and loads. This is because the above-described embodiments have been based on open-loop control of motor 58 and do not take into account factors that may cause variations in the response of patient support apparatus 20 to a force applied to power assist controls 52. Such factors include, but are not limited to, motor inefficiency and variability, different rolling resistances, inaccuracies in theta and/or scale measurements, etc. In order to provide a more uniform response of patient support apparatus 20 to forces applied to power assist controls 52, a closed loop feedback mechanism may be used.

Drive System 50'

Figure 6:
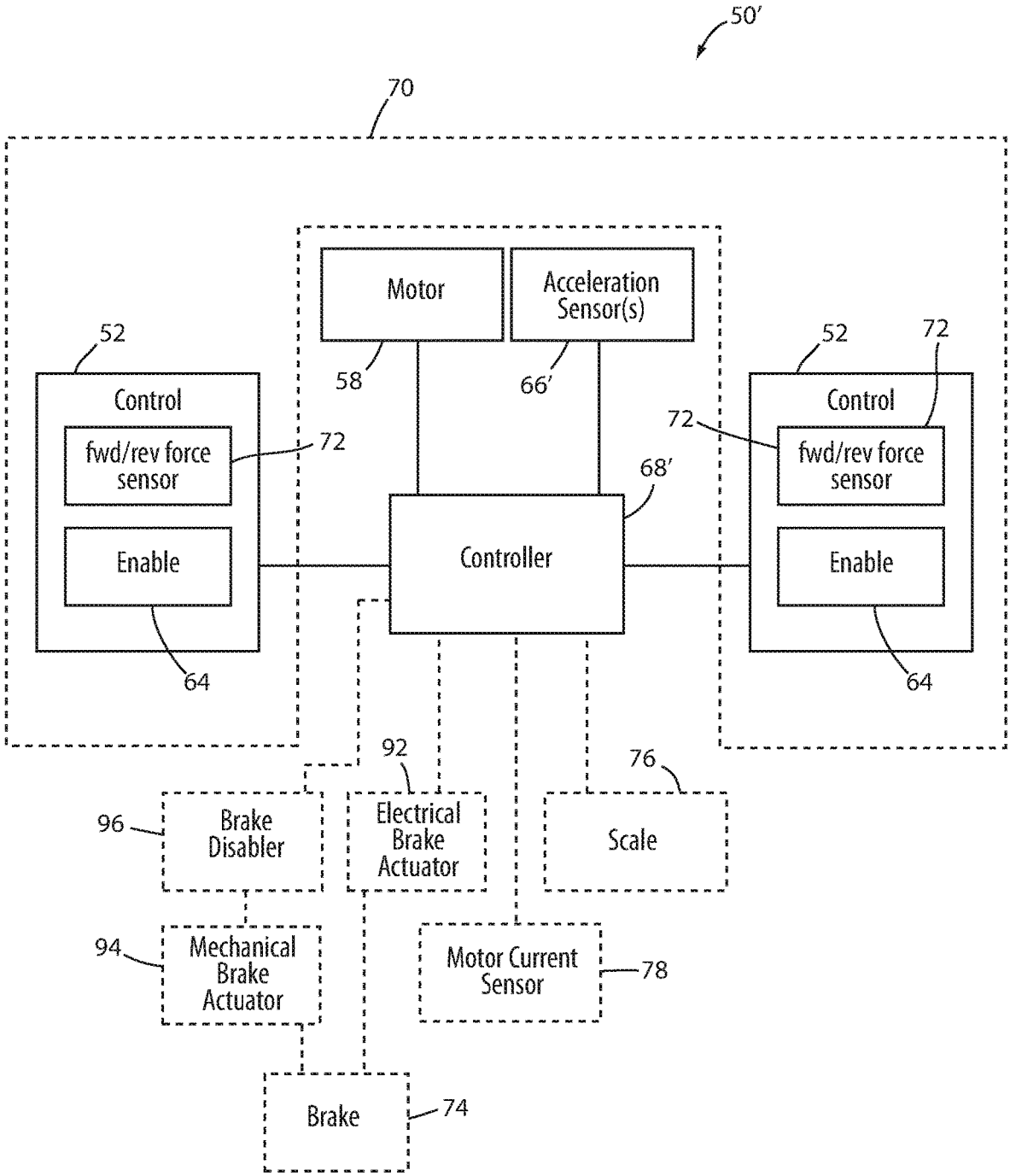
FIG. 6 is a block diagram of a second embodiment of a drive system usable with the patient support apparatus of FIG. 1.

Drive system 50' of FIG. 6 illustrates one embodiment of a drive system that has been modified to include additional features and functions, such as, but not limited to, closed-loop feedback. Those components of drive system 50' that are labeled with identical reference numbers operate in the same manner as discussed above, while those components of drive system 50' that have been modified are identified with the same reference number followed by a prime (') symbol. Drive system 50' may be used in patient support apparatus 20 of FIG. 1, or it may be used in any other suitable type of patient support apparatus, such as a bed, cot, chair, etc.

As shown in FIG. 6, drive system 50' includes a modified sensor 66' and a modified controller 68'. Sensor 66' differs from sensor 66 in that it is modified to detect the amount of acceleration and/or deceleration of patient support apparatus 20 in forward and reverse directions 54 and 56 (FIG. 4). The forward and reverse directions 54 and 56 are aligned with an imaginary longitudinal axis extending from head end 38 to foot end 40 of patient support apparatus. In one embodiment, sensor 66' comprises a single axis accelerometer having a sensing axis that is aligned with the forward and reverse directions 54 and 56. In other embodiments, sensor 66' comprises a multi-axis accelerometer with at least one sensing axis that is aligned with the forward and reverse directions 54 and 56. In still other embodiments, sensor 66' comprises a multi-axis accelerometer having no axes aligned with the forward and reverse directions 54 and 56. Other types of acceleration sensors may be used, including, but not limited to, speed sensors whose outputs are processed to determine acceleration or deceleration, visions sensors, and/or range sensors.

Drive system 50' is configured to perform each of the following functions (1) use closed-loop feedback from the acceleration sensor 66'; (2) detect the tilt of patient support apparatus 20 and limit motion of the patient support apparatus 20 (such as speed or acceleration) if the tilt exceeds a threshold; (3) detect collisions and automatically react to the collisions; (4) prevent the brakes from being manually applied while patient support apparatus 20 is in motion; and (5) perform diagnostic checks of the drive system based upon comparisons of the current draw of motor 58 and the acceleration detected by sensor 66'. It will be understood that, in other embodiments, drive system 50' can be modified to include only a single one of these five functions. Further, in still other embodiments, drive system 50' can be modified to include any combination of these five functions. Finally, it will be understood that any of the second through fifth functions may be added, either individually or in combination, to drive system 50 described above. These five functions and the manners in which they are accomplished are described in greater detail below.

Closed-Loop Acceleration Feedback

Figure 7:
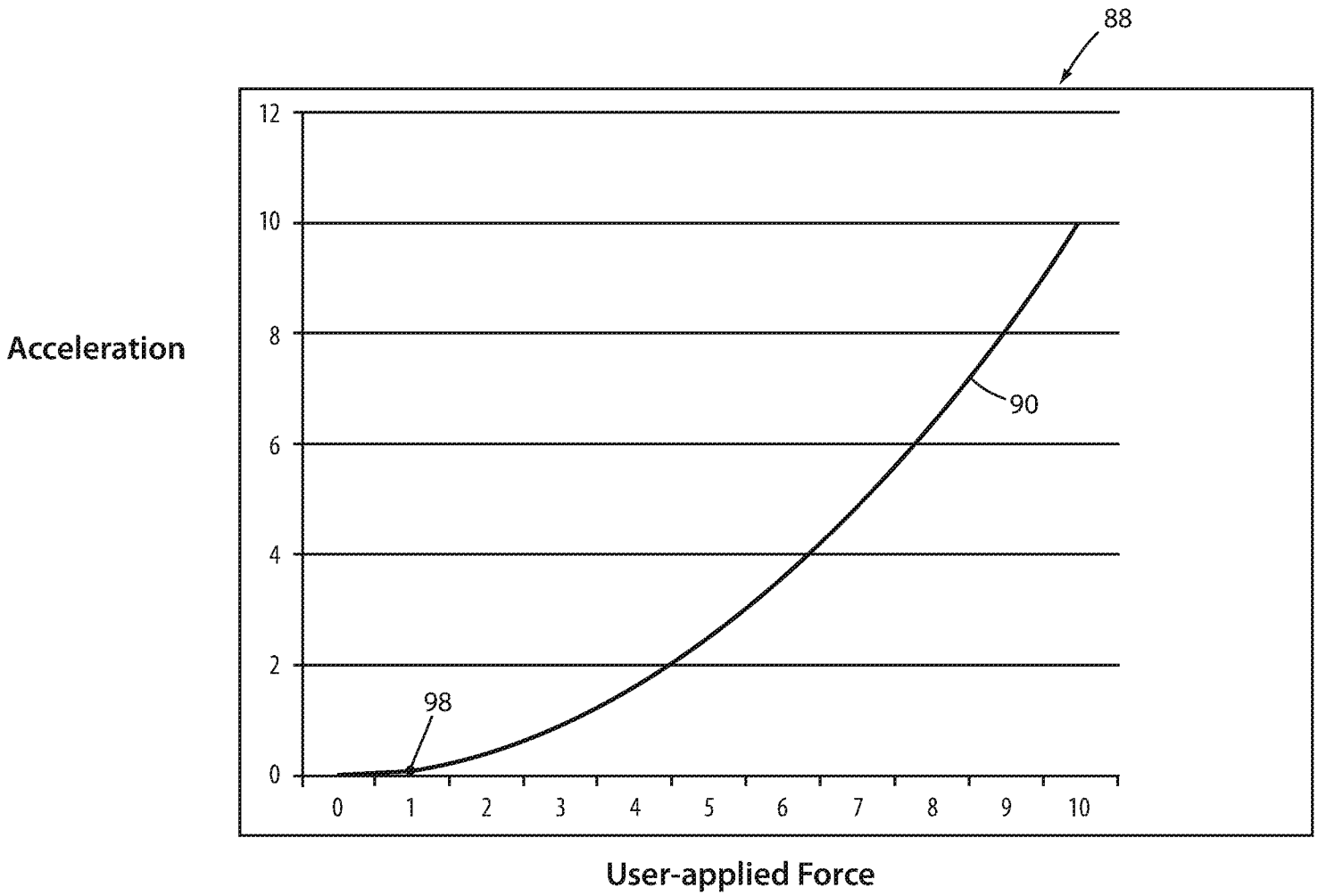
FIG. 7 is a chart illustrating an exemplary profile of the relationship between the force applied to the power assist control and the acceleration that the drive system of FIG. 6 targets for the patient support apparatus.

With respect to the first function mentioned above (controlling motor 58 using closed-loop feedback from acceleration sensor 66'), controller 68' differs from controller 68 in that controller 68' is programmed to output whatever PWM signals are necessary to achieve a target amount of acceleration. That is, unlike controller 68 which attempts to achieve a targeted PWM output, controller 68' attempts to achieve a targeted acceleration. One example of a targeted amount of acceleration that controller 68' is programmed to achieve is shown in graph 88 of FIG. 7. Graph 88 includes an x-axis which indicates the amount of force applied by a user and detected by force sensor 72. The y-axis indicates the acceleration of patient support apparatus 20 in the forward direction 54. Graph 88 also includes an acceleration profile 90 that relates a targeted amount of acceleration to the amount of force applied to patient support apparatus 20 and detected by force sensor 72). Although acceleration profile 90 is shown in FIG. 7 to be have an exponential relationship to the applied force, and to have a positive slope that increases with increasing applied forces, it will be understood that acceleration profile 90 can take on a wide variety of other shapes and forms, such as, but not limited to, a linear relationship, a relationship with decreasing slope, a relationship with a combination of decreasing and increasing slopes, a stepped relationship, and/or other types of relationships.

Controller 68' achieves acceleration profile 90 by repetitively measuring the acceleration sensed by sensor 66', comparing it to the target acceleration corresponding to the applied force, and making appropriate changes in the PWM signals sent to motor 58 if there is a discrepancy between the target acceleration and the measured acceleration. In other words, controller 68' uses closed-loop feedback from sensor 66' to achieve the targeted accelerations of acceleration profile 90. This closed loop feedback can be accomplished in any of a variety of different manners, such as by using a proportional-integral-derivative (PID) control loop, or any variation thereof (e.g. a proportional-integral (PI) control loop; a proportional-derivative (PD) control loop, etc.). Still other types of closed loops may also be used.

By using closed loop control to drive motor 58 toward a target acceleration, patient support apparatus 20 tends to respond to changes in theta and/or loads supported on support surface 34 automatically. In the embodiment shown in FIG. 6, controller 68' does not use data regarding the angular orientation of patient support apparatus 20 (angle theta) or the amount of weight supported on support surface 34 (via a scale system) when commanding motor 58. Instead, controller 68' automatically makes adjustments to the duty cycle of the PWM signals sent to motor 58 in response to errors between the actual acceleration and the target acceleration. Therefore, changes in the inclination of patient support apparatus 20 and/or loads supported thereon are addressed by way of the changes made to the PWM signals in order to achieve the target acceleration. In at least one embodiment of patient support apparatus 20 that uses controller 68', no orientation sensor 66 is included and no scale 76 is included. In other embodiments of patient support apparatus 20 having controller 68', one or more of the orientation sensor 66 and scale 76 are included, but their outputs need not be used by controller 68 in determining how to drive motor 58.

It will be noted that acceleration profile 90 yields an acceleration of zero when the applied force is less than or equal to a threshold force 98. Threshold force 98 can be set at a variety of different locations. In FIGS. 5 and 7, threshold force 98 is located where the applied force is equal to one. Any forces applied to power assist control 52 that are equal to or less than one therefore result in no acceleration or deceleration of patient support apparatus 20. By utilizing threshold force 98, the user must initially apply a force greater than threshold 98 to get patient support apparatus 20 moving. However, after this initial force is applied, the movement of patient support apparatus 20 naturally tends to decrease the amount of force applied by the user due to the movement of patient support apparatus 20 away from the user. When patient support apparatus 20 has obtained a desired speed, the user thereafter has only to push on the power assist control 52 with a small amount of force (less than threshold 98) in order to maintain that speed. Threshold 98 therefore avoids the situation where patient support apparatus 20 is constantly being accelerated or decelerated for any non-zero force applied to power assist control 52.

Whenever the user wishes to decrease the speed of patient support apparatus 20, he or she need only apply a force in the opposite direction (reverse direction 56) to the power assist control 52. Although not illustrated in FIG. 7, controller 68' is implemented in one embodiment to implement a deceleration profile that is similarly shaped to acceleration profile 90. That is, the higher the reverse force applied, the higher the deceleration. Other types of deceleration profiles may also be implemented.

In one embodiment, controller 68' implements the desired deceleration profile through a combination of allowing patient support apparatus 20 to coast and, as necessary, active braking of motor 58. Such active braking is carried out by applying signals to motor 58 that urge motor 58 to rotate in an opposite direction (i.e. drive patient support apparatus 20 in reverse direction 56). In at least one embodiment, such active braking is carried out using any of the principles disclosed in commonly assigned U.S. patent application Ser. No. 14/838,693 filed Aug. 28, 2015 by inventors Daniel Brosnan et al. and entitled PATIENT SUPPORT APPARATUS WITH ACTUATOR BRAKE CONTROL, the complete disclosure of which is hereby incorporated herein by reference. Other types of active braking of the motor 58 may also be utilized. Still further, in some embodiments, controller 68' communicates with either one or both of an electrical brake actuator 92 and a mechanical brake actuator 94 (FIG. 6) that are separate from motor 58 and control activation of brake 74 such that one or more wheels 24 of patient support apparatus 20 are suitably braked to achieve the desired deceleration profile. Other types of controlled braking may also be used.

In at least one embodiment, controller 68' does not actively brake patient support apparatus 20 at all. Instead, controller 68' responds to reverse forces applied to power assist control 52 by decreasing and/or terminating power applied to motor 58 in the forward direction. In such cases, deceleration is achieved by way of frictional losses as patient support apparatus 20 either coasts or is driven with less force.

In still another embodiment, controller 68' achieves controlled braking of patient support apparatus 20 using any of the braking methods (including, but not limited to, regenerative braking) disclosed in commonly assigned U.S. patent application Ser. No. 62/196,396 filed Jul. 24, 2015 by inventors William Childs et al. and entitled SYSTEM AND METHOD OF BRAKING FOR A PATIENT SUPPORT APPARATUS, the complete disclosure of which is hereby incorporated herein by reference.

Tilt Detection

As was noted above, drive system 50' is also configured to detect a tilt (angle theta) of patient support apparatus 20 relative to horizontal plane 82. However, unlike drive system 50 which uses the angle theta to choose a duty cycle for the PWM signals, drive system 50' does not use the theta angle to compute a duty cycle (the duty cycle, as noted above, is computed based on closed-loop feedback of the measured acceleration compared to the target acceleration). Drive system 50', however, does use the theta angle to limit how it drives motor 58. In one embodiment, this limiting involves setting a maximum speed at which drive system 50' drive motor 58. In another embodiment, this limiting involves setting a maximum acceleration or deceleration of patient support apparatus 20 that drive system 50' causes. In still other embodiments, other types of limits are imposed.

Drive system 50' determines the tilt angle theta in at least one embodiment by using a modified sensor 66' that detects both the tilt of patient support apparatus 20 and its acceleration and deceleration in the forward and reverse directions 54 and 56. In one embodiment, this sensor 66' includes a tri-axis accelerometer that senses both the angular deviation of patient support apparatus 20 from a substantially horizontal plane 82 (tilt angle theta) and the acceleration and deceleration of patient support apparatus 20 in the forward and reverse directions 54 and 56. Such a tri-axis accelerometer has at least one of its axes aligned with the forward-reverse direction, in at least one embodiment, although other embodiments do not include such alignment. Those other embodiments detect the forward-reverse accelerations by mathematically resolving each of the sensed accelerations into their axial components of a coordinate frame of reference that is aligned with the forward-reverse direction.

Controller 68' determines if a potential tipping hazard exists by comparing the measured tilt angle theta to one or more thresholds. The thresholds are based upon empirical data for a particular model of patient support apparatus 20 and take into account such factors as the height, weight, and center of mass patient support apparatus 20, as well as assumptions (in one embodiment) about the weight of the patient on support surface 34. The thresholds are stored in a memory (not shown) on board patient support apparatus 20 that is accessible to controller 68'.

If controller 68' determines that a potential tipping hazard exists, controller 68' changes its control of motor 58 such that accelerations (or decelerations) are reduced in response to signals from power assist control 52, thereby lessening any torque on patient support apparatus 20 that may result from such accelerations (or decelerations), and thereby reducing the likelihood of patient support apparatus 20 tipping when it is accelerated or decelerated. In some of the embodiments where controller 68' is modified to determine a potential tipping hazard, controller 68' also receives inputs from scale 75 and one or more height sensors that sense the height of lifts 26. Using this height and weight information, controller 68' estimates the center of mass of the patient support apparatus 20, rather than relying upon an assumption or other static value, and uses this estimate in the determination of whether or not to reduce the accelerations and decelerations, as well as the magnitude of any such reduction.

Still further, in at least one embodiment, the center of gravity of the load supported on patient support surface 34 is also used by controller 68' in estimating the center of mass of patient support apparatus 20. Techniques for estimating the center of gravity of the load supported on support surface 34 are disclosed in commonly assigned U.S. patent application Ser. No. 62/253,167 filed Nov. 10, 2015, by inventors Marko Kostic et al. and entitled PATIENT SUPPORT APPARATUSES WITH ACCELERATION DETECTION, as well as the aforementioned U.S. Pat. No. 5,276,432 issued to Travis, the complete disclosures of both of which are hereby incorporated herein by reference. As disclosed in the '167 patent application, accelerometers may be used to estimate the position and/or motion of a patient while positioned on patient support apparatus 20. As least one of the accelerometers disclosed in the '167 patent application is, in one embodiment, the same accelerometer that comprises sensor 66'.

The 62/253,167 patent application also describes techniques for using accelerometers for detecting the height and orientation of a patient support apparatus, such as a cot, whose litter height is adjusted by changing the orientation of one or more legs of the patient support apparatus. In one embodiment of patient support apparatus 20, controller 68 utilizes such accelerometers to determine the height and orientation of the litter or frame 28 (in the manner disclosed in the '167 patent application) and either prevents the driving of motor 58 or reduces the level at which motor 58 is driven in response to a tipping hazard detected by the accelerometers. Still further, controller 68 is modified in some embodiments to utilize the angle or angles of the sections of support deck 30 when determining whether to prevent or reduce the driving of motor 58. Thus, for example, if a Fowler section of deck 30 is angled in such a manner that, given the overall orientation, height, and center of gravity of patient support apparatus 20, that a tipping hazard exists when motor 58 is driven, controller 68 either prevents the driving of motor 58 or reduces the level at which motor 58 can be driven.

In still other embodiments, patient support apparatus 20 uses one or more accelerometers, or other sensors, to determine the angular orientation of one or more pieces of equipment supported by patient support apparatus 20. Such equipment may include an IV pole, a heart monitor, a ventilator, a DVT pump, an oxygen tank, and/or other equipment. Controller 68 uses the angular orientation of this equipment, as well as stored or measured values corresponding to a weight of this equipment, to calculate the equipment's effect on the tipping potential of patient support apparatus 20. That is, controller 68 calculates the tipping potential of patient support apparatus 20 due to accelerating or decelerating motor 58 when the equipment is in its current orientation. If this tipping hazard exceeds a threshold, controller 68 reduces the speed at which motor 58 can be accelerated.

Collision Detection

Drive system 50' is also configured to detect any collisions of patient support apparatus 20. When used to detect collisions, acceleration sensor 66' includes an accelerometer that detects linear accelerations in three orthogonal directions. Further, in some embodiments where collision detection is carried out, drive system 50' also includes sensors for detecting angular accelerations of patient support apparatus 20 about one or more of three orthogonal axes (e.g. up-down, side-to-side, and front-to-back). Such sensors include one or more gyroscopes in one embodiment. In other embodiments, alternative and/or additional sensors are used to detect angular accelerations of patient support apparatus 20.

Controller 68' of drive system 50' detects collisions by monitoring the outputs of acceleration sensor 66' and looking for linear or angular accelerations that exceed one or more thresholds. The thresholds are chosen such that they exceed the accelerations that are normally encountered by patient support apparatus 20 during its ordinary usage. The thresholds are therefore gathered empirically, in at least one embodiment. In some embodiments, the linear acceleration thresholds are the same for each of the axes along which linear acceleration is detected and the angular acceleration thresholds are the same for each of the axes about which angular acceleration is detected. In other embodiments, one of more of the linear acceleration thresholds are different from the other linear acceleration thresholds, and/or one or more of the angular acceleration thresholds are different from the other angular acceleration thresholds. In at least one embodiment, one or more thresholds are dynamically changed based upon the speed of patient support apparatus 20.

When controller 68' determines that one or more of the detected linear and/or angular accelerations exceeds its corresponding threshold, controller 68' concludes that a collision has been detected. In response to the detected collision, controller 68' is programmed to terminate power to motor 58 for a predetermined time period. In one embodiment, the predetermined time period is a specific number of seconds. In another embodiment, the predetermined time period is a variable amount of time that corresponds to the occurrence of a specific event (e.g. patient support apparatus 20 coming to a complete stop). Regardless of the specific manner in which the predetermined time period is defined, during the time between the collision detection and the expiration of the predetermined time period, controller 68' is programmed to terminate power to motor 58, regardless of whether or not the user is applying a force to one of the power assist controls 52. That is, controller 68' overrides inputs from power assist controls 52 during this interim period.

In one embodiment, in addition to terminating power to motor 58 after detecting a collision, controller 68' is also programmed to apply the brake 74 to patient support apparatus 20 until patient support apparatus 20 comes to a complete stop. The manner in which controller 68' applies the brake may take on any of the forms noted above (e.g. commanding a brake actuator 92 or 94 (FIG. 6) to activate brake 74; applying a reverse drive signal to motor 58; using motor 58 for regenerative braking; and/or a combination of one or more of these or other techniques). In at least one of these embodiments, controller 68' uses closed looped feedback from acceleration sensor 66' during the braking process to achieve a desired and controlled level of deceleration. Once patient support apparatus 20' has come to a complete stop, controller 68' returns to driving motor 58 in response to forces applied to power assist controls 52 in the manners discussed above.

Controller 68' is also programmed, in at least one embodiment, to keep a log of the collisions detected, including a time stamp of when the collisions occurred and numerical values corresponding to the severity of the collision. The numerical values correspond to the magnitudes of the accelerations (both linear and angular) that are sensed, as well as the directions of the accelerations. In one embodiment, controller 68' is further programmed to compare the accelerations of the detected collisions to one or more higher thresholds and provide a notice to the user if the higher thresholds are exceeded. The higher thresholds correspond to accelerations that are so high that damage may have occurred to one or more components of patient support apparatus 20. The notification to the user therefore instructs the user to have patient support apparatus 20 inspected to see if one or more of the components has been damaged.

Brake Control

Drive system 50' is also configured such that controller 68' detects when patient support apparatus 20 is in motion and prevents the manual application of the brake to patient support apparatus 20 during such motion. Many brake systems are designed for patient support apparatuses that can be damaged if they are manually applied while the patient support apparatus is in motion. In order to prevent this damage potential, controller 68' automatically prevents the activations of the brake while patient support apparatus 20 is in motion.

Controller 68' determines when patient support apparatus 20 is in motion by monitoring the outputs of accelerations sensor 66'. Specifically, controller 68' sums the amount of acceleration in both the forward direction 54 and the reverse direction 56 over time. When the sum of the forward accelerations does not substantially match the sum of the decelerations, controller 68' concludes that patient support apparatus 20' is in motion. Many different manners for detecting the movement of patient support apparatus 20 can alternatively, or additionally, be used. Such additional or alternative manners include the use of an encoder coupled to one of the wheels, or a velocity sensor that measures velocity directly.

Controller 68' operates in different manners in order to prevent the brake 74 from being manually applied by a user, depending upon whether brake 74 is activated solely by an electrical brake actuator 92, solely by a mechanical brake actuator 94, or by a combination of both. Electrical brake actuator 92 is, in one embodiment, a solenoid that, when activated in response to a command from controller 68', moves one or more components of patient support apparatus 20 that activate brake 74. If patient support apparatus 20 is configured such that it includes only electrical brake actuator 92 (and no mechanical brake actuator 94), controller 68' prevents brake 74 from being manually applied by either sending a signal to actuator 92 instructing it not to activate brake 74 or by simply not forwarding any brake commands to electrical brake actuator 92 in response to a user pressing a brake button (or otherwise manipulating a control that normally causes brake actuator 92 to activate brake 74).

Mechanical brake actuator 94 is, in one embodiment, a plurality of pedals that each mechanically control the activation and deactivation of brake 74. Specifically, mechanical brake actuator 94 includes a plurality of pedals that, when either one of them is pressed in a first manner (such as being pressed on a first end) activate brake 74, and when either one is pressed in a second manner (such as being pressed on an opposite end) deactivate brake 74. In order to disable mechanical brake actuator 94 when patient support apparatus 20 is in motion, controller 68' sends a signal to brake disabler 96. Brake disabler may take on a wide variety of different forms. In one embodiment, it includes a clutch that engages and disengages the mechanical connection between the mechanical brake actuator 94 and brake 74. In this manner, when brake disabler 96 is activated and a user presses on one of the brake pedals, brake 74 is not activated.

If patient support apparatus 20 includes both electrical brake actuator 92 and mechanical brake actuator 94, controller 68' both disables electrical brake actuator 92 and commands brake disabler 96 to disable mechanical brake actuator 94 while patient support apparatus 20 is in motion. The user therefore cannot activate brake 74 using either a manual control (e.g. pedal) or an electrical control (e.g. a button).

In those embodiments where controller 68' is programmed to automatically activate brake 74 in certain situations—such as when a collision is detected or, in some cases, when a force is applied to power assist control 52 in reverse direction 56—controller 68' overrides brake disabler 96 and continues to activate brake 74 in those situations. Controller 68' therefore prevents a user from manually activating brake 74 while patient support apparatus 20 is in motion, but does not itself cease to activate brake 74 if the situation warrants.

It will be understood by those skilled in the art that the brake control function of drive system 50' can also be applied to patient support apparatuses 20 that do not include any drive system at all. For example, this brake control function can be applied to a patient support apparatus that is propelled solely through forces applied by a user and that does not include any motor 58 for driving any of the wheels 24. When applied to such a patient support apparatus, the brake control function prevents a user from applying the brake whenever the patient support apparatus is still in motion. As with patient support apparatus 20, this function helps prevent damage to the brake that might otherwise occur were the brake applied while the patient support apparatus was in motion.

Diagnostic Evaluations

Drive system 50' is also configured such that controller 68' uses the outputs of acceleration sensor 66' to perform diagnostic evaluations of drive system 50'. Controller 68' performs these diagnostic evaluations by comparing the amount of current drawn by motor 58, as detected by current sensor 78, with the amount of acceleration of patient support apparatus 20 in the direction in which motor 58 is being driven, as detected by acceleration sensor 66'. In making this comparison, controller 68' utilizes a stored set of thresholds or ranges corresponding to acceptable amounts of current draw for the differing amounts of acceleration. If the current draw is outside of its corresponding acceptable range, or exceeds the corresponding threshold, then controller 68' concludes that there is a problem with drive system 50' and provides a notice to the user. For example, if controller 68' detects a large current draw for a relatively small amount of acceleration, it may be an indication that patient support apparatus 20 is overloaded, or that motor 58 needs servicing, or that drive system 50' has some other issue. Controller 68 thus provides notice to the user indicating that drive system 50' should be serviced by an authorized technician.

In some embodiments, controller 68' is further programmed to stop driving motor 58 and/or brake patient support apparatus 20 if the amount of current draw exceeds the acceptable range or threshold by more than a predefined amount. Controller 68' is therefore able to proactively avoid running motor 58 in a situation that might otherwise cause damage to motor 58 and/or other components of drive system 50'.

Still further, in some embodiments, the acceptable ranges of current draw for given accelerations are based upon the horizontal component of the acceleration vector. In other embodiments, however, the acceptable ranges of current draw for given accelerations are based upon the magnitude of the acceleration in the direction of motion of the patient support apparatus 20, which may or may not be the same as the horizontal component of this acceleration.

Steering

Although the discussion so far has focused primarily on drive systems 50 and 50' that drive one or more motors 58 in forward and reverse directions 54 and 56, it will be understood by those skilled in the art that any of the functions and features described above may be incorporated into a drive system that also provides power-assisted steering to a patient support apparatus. For example, commonly assigned U.S. Pat. No. 9,259,369 issued to Derenne et al. and entitled POWERED PATIENT SUPPORT APPARATUS, the complete disclosure of which is hereby incorporated herein by reference, discloses patient support apparatuses that include one or more motors for steering one or more wheels in response to forces applied by the user to the patient support apparatus. When one or more of the features of the present disclosure are incorporated into one of these types of patient support apparatuses that have powered steering, controller 68 and/or 68' may be modified to take into account the tilt of patient support apparatus 20 in its lateral (i.e. side-to-side) direction in addition to its longitudinal direction (i.e. in the forward and reverse directions 54 and 56). Inclines or declines in this lateral direction are detected by sensors 66 or 66' and controller 68 and/or 68' use these angles when deciding how to drive motor 58 and/or how to brake the patient support apparatus. For example, the controller may reduce the speed of motor 58 if there is a lateral tipping hazard, or the controller may adjust the power applied to motor 58 if the patient support apparatus is traveling in a direction having an uneven lateral component.

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A patient support apparatus comprising: a frame; a plurality of wheels; a patient support surface adapted to support a patient thereon; a motor adapted to drive at least one of the wheels; a power assist control positioned on the patient support apparatus and adapted to detect a force applied to the power assist control; a sensor adapted to detect an angular orientation of the patient support apparatus with respect to a substantially horizontal plane; and a controller in communication with the power assist control, the motor, and the sensor, the controller adapted to drive the motor at different levels for a particular force applied to the power assist control depending upon the angular orientation sensed by the sensor; the controller further adapted to use feedback from the sensor such that the patient support apparatus accelerates at substantially the same rate, for different angular orientations, when the particular force is applied.

2. The patient support apparatus of claim 1 wherein the controller drives the motor at a first level when the patient support apparatus is oriented at a first angular orientation and the particular force is applied, and the controller drives the motor at a second level when the patient support apparatus is oriented at a second angular orientation and the particular force is applied, the first level being higher than the second level and the first angular orientation being steeper than the second angular orientation.

3. The patient support apparatus of claim 1 further including a scale coupled to the patient support surface and adapted to detect a weight on the patient support surface, the controller being in communication with the scale and adapted to drive the motor at different levels for the particular force applied to the power assist control depending upon the weight detected by the scale.

4. The patient support apparatus of claim 1 wherein the controller drives the motor at different levels by sending pulse width modulated signals of different duty cycles to the motor.

5. The patient support apparatus of claim 1 wherein the sensor is further adapted to detect an acceleration of the patient support apparatus due to the motor being driven.

6. The patient support apparatus of claim 5 wherein the controller uses the acceleration detected by the patient support apparatus to determine at what level to drive the motor.

7. The patient support apparatus of claim 5 wherein the controller is further adapted to use the sensor to detect a collision with the patient support apparatus and to automatically slow down the patient support apparatus in response to the detected collision.

8. The patient support apparatus of claim 5 further including a current sensor adapted to detect an amount of current drawn by the motor, wherein the controller is adapted to compare the amount of current drawn by the motor with the acceleration detected by the sensor to determine if an error condition exists.

9. The patient support apparatus of claim 5 wherein the controller is further adapted to prevent a brake from being applied while the patient support apparatus is in motion.

10. The patient support apparatus of claim 1 wherein the controller does not drive the motor at all if the sensor indicates an unsafe orientation of the patient support apparatus.

11. A patient support apparatus comprising: a frame; a plurality of wheels; a patient support surface adapted to support a patient thereon; a motor adapted to drive at least one of the wheels; a power assist control positioned on the patient support apparatus and adapted to detect a force applied to the patient support apparatus; a sensor adapted to detect an angular orientation of the patient support apparatus with respect to a substantially horizontal plane; and a controller in communication with the power assist control, the motor, and the sensor, the controller adapted to drive the motor such that the patient support apparatus accelerates at substantially the same rate, for different angular orientations, when a particular force is applied to the power assist control.

12. The patient support apparatus of claim 11 wherein the controller is further adapted to brake the motor such that the patient support apparatus decelerates at substantially the same rate, when a particular braking force is applied to the power assist control.

13. The patient support apparatus of claim 11 wherein the controller is adapted to drive the motor by sending pulse width modulated signals of different duty cycles to the motor.

14. The patient support apparatus of claim 13 wherein the controller is adapted to send pulse width modulated signals to the motor having a first duty cycle when the patient support apparatus is level and the particular force is applied, and the controller is adapted to send pulse width modulated signals to the motor having a second duty cycle when the patient support apparatus is upwardly inclined and the particular force is applied, the second duty cycle being greater than the first duty cycle.

15. The patient support apparatus of claim 13 wherein the sensor also detects an acceleration of the patient support apparatus caused by the motor being driven.

16. The patient support apparatus of claim 15 wherein the controller uses the detected acceleration for closed-loop feedback control of the motor.

17. The patient support apparatus of claim 15 wherein the controller is further adapted to use the sensor to detect a collision with the patient support apparatus and to automatically slow down the patient support apparatus in response to the detected collision.

18. The patient support apparatus of claim 17 wherein the controller automatically slows down the patient support apparatus in response to the detected collision by driving the motor in an opposite direction.

19. The patient support apparatus of claim 15 further including a current sensor adapted to detect an amount of current drawn by the motor, wherein the controller is adapted to compare the amount of current drawn by the motor with the acceleration detected by the sensor to determine if an error condition exists.

20. The patient support apparatus of claim 15 wherein the controller is further adapted to prevent a brake from being applied while the patient support apparatus is in motion.

21. The patient support apparatus of claim 11 wherein the controller is adapted to not drive the motor if the controller determines the angular orientation to be an unsafe orientation.

22. A patient support apparatus comprising:

a frame;

a plurality of wheels;

a patient support surface adapted to support a patient thereon;

a motor adapted to drive at least one of the wheels;

a power assist control positioned on the patient support apparatus and adapted to detect a force applied to the patient support apparatus;

a sensor adapted to detect an angular orientation of the patient support apparatus with respect to a substantially horizontal plane;

a scale in communication with the controller and adapted to detect an amount of weight supported on the patient support surface; and a controller in communication with the power assist control, the motor, and the sensor, the controller adapted to determine a maximum value used in driving the motor based upon the angular orientation sensed by the sensor and to drive the motor in response to the force applied to the power assist control in a manner such that the maximum value is not exceeded, the controller further adapted to use the amount of weight detected by the scale to determine the maximum value.

23. The patient support apparatus of claim 22 wherein the controller automatically re-determines the maximum value based upon subsequently detected angular orientations of the patient support apparatus by the sensor.

24. The patient support apparatus of claim 22 wherein the maximum value is a maximum acceleration of the patient support apparatus.

25. The patient support apparatus of claim 22 wherein the maximum value is a maximum speed of the patient support apparatus.

* * * * *